US008390523B2

(12) United States Patent
Wang et al.

(10) Patent No.: US 8,390,523 B2
(45) Date of Patent: Mar. 5, 2013

(54) PLANAR INVERTED-F ANTENNA AND WIRELESS NETWORK DEVICE HAVING THE SAME

(75) Inventors: Yu-Jen Wang, Taipei (TW); Wei-Bin Lee, Taipei (TW)

(73) Assignee: Cameo Communications Inc (TW)

( * ) Notice: Subject to any disclaimer, the term of this patent is extended or adjusted under 35 U.S.C. 154(b) by 337 days.

(21) Appl. No.: 12/807,585

(22) Filed: Sep. 8, 2010

(65) Prior Publication Data

US 2011/0304510 A1 Dec. 15, 2011

(30) Foreign Application Priority Data

Jun. 9, 2010 (TW) ..... 99210938 U

(51) Int. Cl.
*H01Q 1/24* (2006.01)
*H01Q 13/10* (2006.01)

(52) U.S. Cl. ..... 343/702; 343/770

(58) Field of Classification Search ..... 343/702, 343/767, 770, 700 MS
See application file for complete search history.

(56) References Cited

U.S. PATENT DOCUMENTS 6,414,637 B2 * 7/2002 Keilen ..... 343/700 MS
7,505,004 B2 * 3/2009 Chen et al. ..... 343/702

* cited by examiner

*Primary Examiner* — Hoang V Nguyen

(57) ABSTRACT

A planar inverted-F antenna for use in a wireless network device comprises a connecting member and two radiators. The connecting member has at least one input end and at least one ground end. Each radiator has a first end portion perpendicularly connected to one of the two ends of the connecting member, and the two radiators are parallel and correspond in shape to each other. Each radiator further has an L-shaped notch and thus forms a barb. A second end portion of each radiator is bent to form an engaging end which is generally parallel to the connecting member and configured to fasten with a substrate of the wireless network device.

18 Claims, 11 Drawing Sheets

PLANAR INVERTED-F ANTENNA AND WIRELESS NETWORK DEVICE HAVING THE SAME

BACKGROUND OF INVENTION

1. Field of the Invention

The present invention relates to a planar inverted-F antenna (PIFA) and, more particularly, to an integrally formed single-band antenna suitable for use in a wireless network device, and a wireless network device having such an antenna.

2. Description of the Prior Art

Please refer to FIG. 1 for a perspective view of a conventional wireless network device 10 in the form of a wireless network card. The wireless network device 10 typically includes: a main body 11, an internal circuit device 12 provided in the main body 11, a connector portion 13 located at one end of the main body 11 and configured for connecting with an external host (not shown), and an antenna signal transceiver portion 14 disposed at the end of the main body 11 that is opposite the connector portion 13. Generally, the antenna signal transceiver portion 14 has a non-metal housing and, when the wireless network device 10 is connected to an external host, must be exposed outside the external host in order to transmit and receive wireless signals effectively.

FIG. 2 shows a conventional internal circuit device 20 for use in a wireless network device. The internal circuit device 20 includes: a substrate 21, a control circuit 22 provided on the substrate 21, a grounding element 23 covering a predetermined region of the substrate 21, and an antenna unit 24 electrically connected to the control circuit 22. The conventional antenna unit 24 shown in FIG. 2 includes a first antenna 241 and a second antenna 242 which are provided on two lateral sides of the substrate 21, respectively. Moreover, the antennas 241, 242 of the conventional internal circuit device 20 are both designed as printed monopole antennas on the substrate 21. However, due to their limited difference in height in the vertical direction, such printed antennas can only achieve the desired radiation patterns and high gain in the X-Y plane (i.e., along the horizontal directions) by varying the shapes of the first and second antennas 241, 242 but can hardly be improved in terms of gain in the Z direction. With the "vertical stand" design being the design trend of today's wireless network devices in order to save space and lend a sense of modernity and technology to the devices, the low gain of the conventional printed antennas particularly in the Z direction simply cannot satisfy the requirements of wireless network devices having a vertical stand configuration.

For instance, FIG. 3 shows X-Y plane radiation patterns plotted from test results of the first antenna 241 of the conventional printed antenna unit 24 illustrated in FIG. 2. As can be seen in the radiation patterns of FIG. 3, the maximum gain of the first antenna 241 in the vertical direction is merely −15.89 dBi, which is obviously lower than consumers' acceptable lower gain limit (typically −10 dBi) and therefore does not meet the design requirements of high-performance antennas on the market.

SUMMARY OF INVENTION

It is an object of the present invention to provide a planar inverted-F antenna whose single-plate single-band antenna structure is integrally formed by stamping so as to minimize the overall volume of a wireless network device equipped with such an antenna.

In order to achieve the aforementioned objective, the present invention discloses a planar inverted-F antenna which comprises:

a connecting member having at least an input end and at least a ground end; and two radiators each having a first end portion perpendicularly connected to the connecting member, the two radiators being parallel and corresponding in shape to each other;

wherein each the radiator has an L-shaped notch and thus forms a barb, and each the radiator has a second end portion bent into an engaging end, the engaging ends being parallel to the connecting member.

In a preferred embodiment, the planar inverted-F antenna is a single-piece three-dimensional element integrally formed by stamping a thin conductive metal plate.

In a preferred embodiment, the connecting member has two ends connected to the two radiators, respectively, and each the end has a height greater than a height of each the input end and of each the ground end.

In a preferred embodiment, there are two the input ends and two the ground ends, and the two input ends are provided on two sides of the two ground ends, respectively.

In a preferred embodiment, the engaging ends formed by bending the radiators and the L-shaped notches are engaged with a substrate of a wireless network device and, more specifically, are engaged with recesses and positioning ends formed at a periphery of the substrate, respectively, and each the radiator has a surface perpendicular to a surface of the substrate.

In a preferred embodiment, the at least a ground end is electrically connected to a grounding portion of the substrate, and the at least an input end is electrically connected to a control circuit of the substrate.

In a preferred embodiment, the planar inverted-F antenna operates in a frequency band ranging from 2.4 GHz to 2.5 GHz.

In a preferred embodiment, the L-shaped notch of each the radiator has: an open section extending in a same direction as the at least an input end and the at least a ground end; and a slot which is perpendicular to the open section and extends toward the second end portion of the radiator where a corresponding the engaging end is formed.

In a preferred embodiment, the connecting member has two ends connected with the two radiators, respectively, each the end of the connecting member having a height H, each the radiator having a length L1, the connecting member having a length L2, the open section of each the L-shaped notch having a width W1, and the slot of each the L-shaped notch having a width W2, in which:

$3\ \text{mm} < H < 5\ \text{mm}$;

$11\ \text{mm} < L_1 < 14\ \text{mm}$;

$10\ \text{mm} < L_2 < 15\ \text{mm}$;

$0.5\ \text{mm} < W_1 < 3\ \text{mm}$; and $0.2\ \text{mm} < W_2 < 1.5\ \text{mm}$.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF PREFERRED EMBODIMENTS

In the present invention, a planar inverted-F antenna and a wireless network device having the same are designed on the principle that a three-dimensional antenna integrally formed by stamping can be rapidly assembled to the substrate of a wireless network device and minimize the overall volume of resultant assembly. In particular, the planar inverted-F antenna of the present invention has two unique barb-shaped radiators for providing the desired wireless communication frequency band (e.g., 2.2 GHz~2.6 GHz). Thus, the planar inverted-F antenna not only has a small volume but also can be conveniently manufactured and assembled, thereby reducing associated costs.

Refer to FIG. 4 and FIGS. 5A to 5C for a perspective view, a top view, a left-side view, and a front view, respectively, of a planar inverted-F antenna 5 according to a preferred embodiment of the present invention. The planar inverted-F antenna 5 is a resilient, three-dimensional, single-plate element integrally formed by bending a thin conductive metal plate (e.g., of copper, iron, aluminum, tin, nickel, silver, chromium, gold, or an alloy thereof) through a stamping process. Therefore, except at the bent portions, the planar inverted-F antenna 5 has a substantially uniform thickness.

Figure 4:
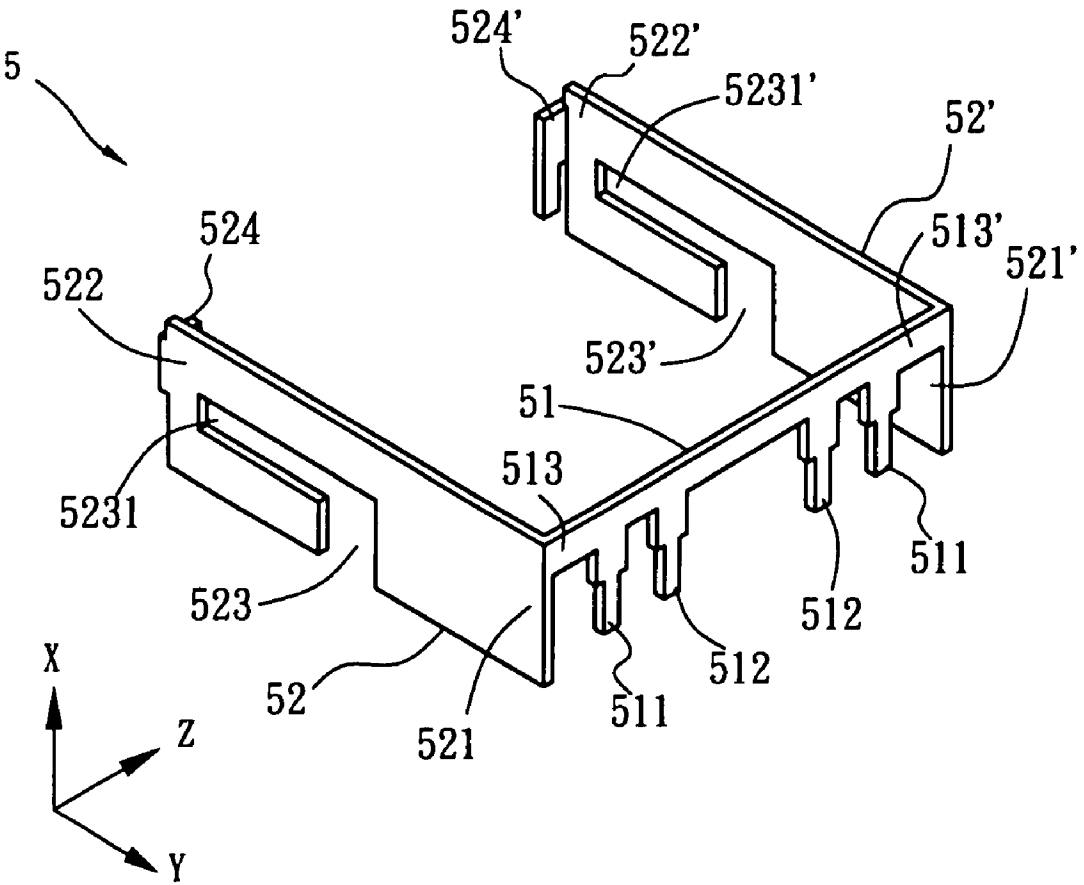
FIG. 4 is a perspective view of a planar inverted-F antenna according to a preferred embodiment of the present invention.
Figure 5A:
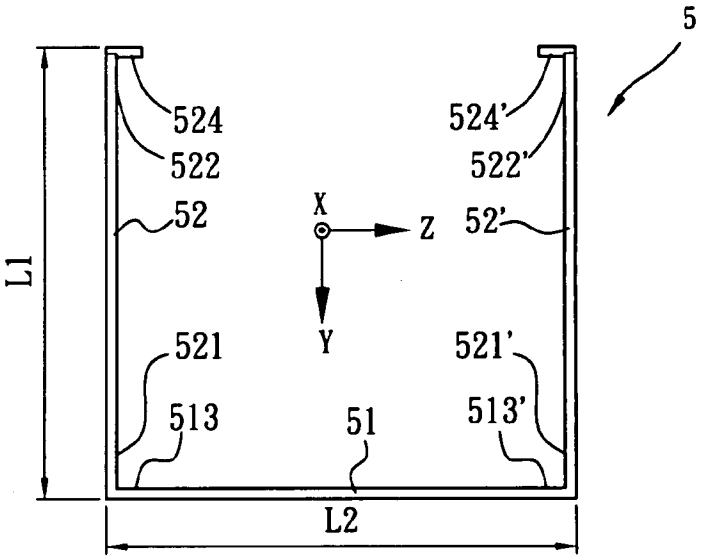
FIG. 5A is a top view of the planar inverted-F antenna shown in FIG. 4.
Figure 5B:
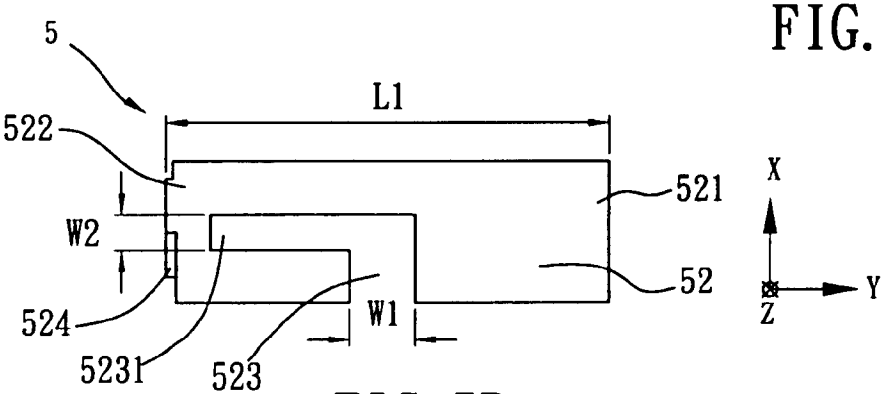
FIG. 5B is a left-side view of the planar inverted-F antenna shown in FIG. 4.
Figure 5C:
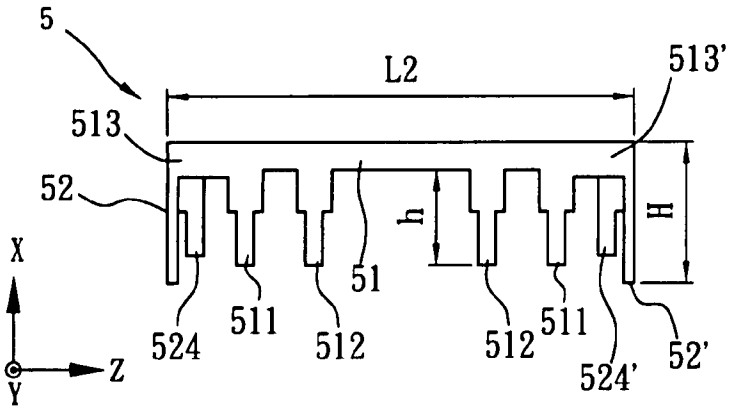
FIG. 5C is a front view of the planar inverted-F antenna shown in FIG. 4.

As shown in FIG. 4, the planar inverted-F antenna 5 in the present embodiment is a single-piece element integrally formed by stamping a thin conductive metal plate and has a generally U-shaped structure when viewed from the top. The planar inverted-F antenna 5 includes a connecting member 51 and left and right radiators 52, 52'. When viewed from the top (as shown in FIG. 5A), the connecting member 51 is a slender member extending transversely at the bottom side of the U-shaped structure and has two ends 513, 513' which are bent vertically upward and extended to form the left and right radiators 52, 52', respectively. When viewed from the front (as shown in FIG. 5C), the connecting member 51 has at least one input end 511 and at least one ground end 512. In the present embodiment, there are two input ends 511 and two ground ends 512, all of which are formed by continuously stamping the connecting member 51 such that the input ends 511 and the ground ends 512 extend vertically downward and are spaced apart from one another by predetermined distances. In addition, the two ground ends 512 are at a central region of the connecting member 51 while the input ends 511 are on the left and right sides of the two ground ends 512, respectively.

In other words, four spaced metal contacts (i.e., the two input ends 511 and the two ground ends 512) are formed on the connecting member 51 by stamping. The two metal contacts that are closer to the center of the connecting member 51 are the ground ends 512; the two metal contacts that are closer to the ends 513, 513' of the connecting member 51 are the input ends 511.

Figure 6A:
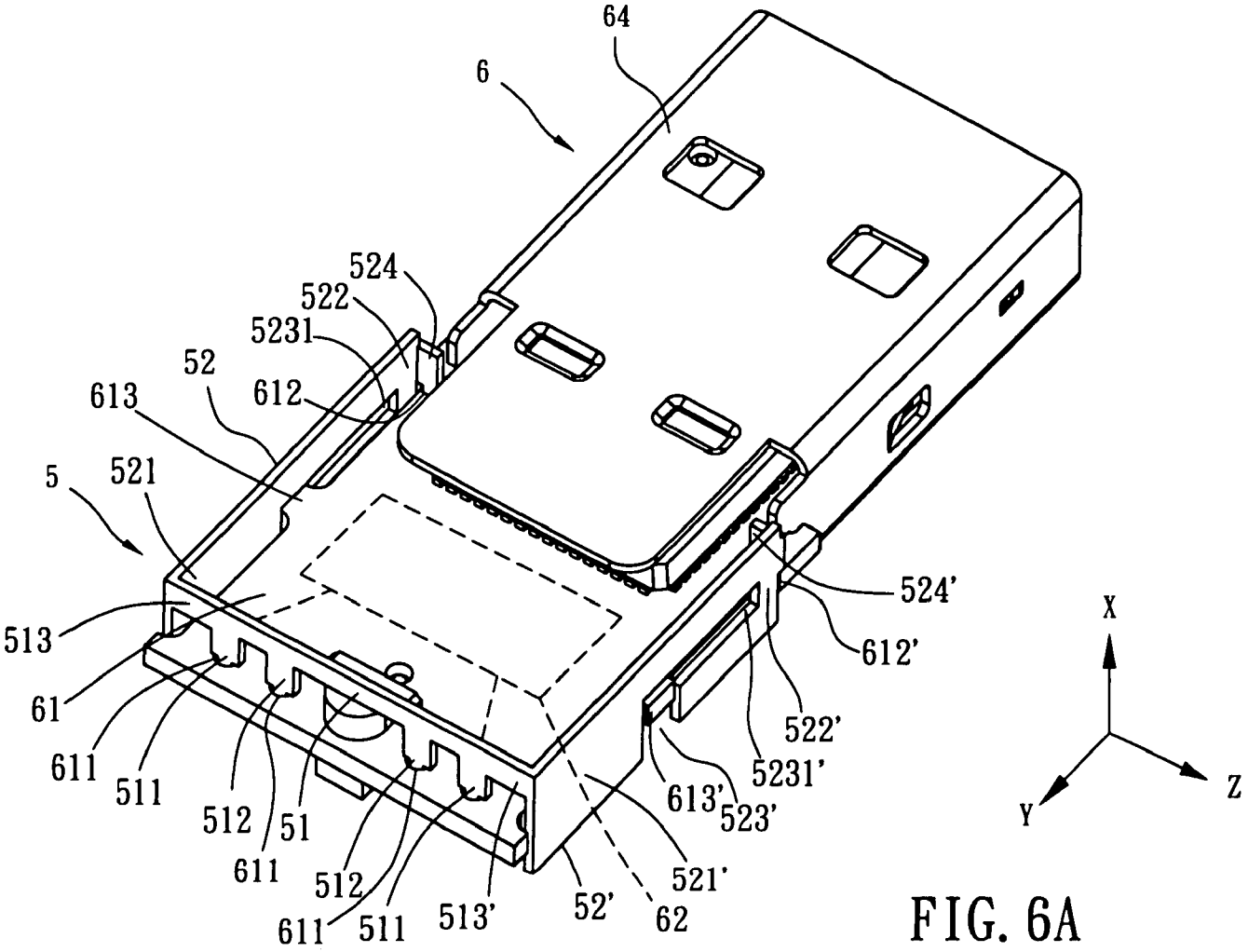
FIG. 6A is a top perspective view of an embodiment of a wireless network device having the planar inverted-F antenna of the present invention.
Figure 6B:
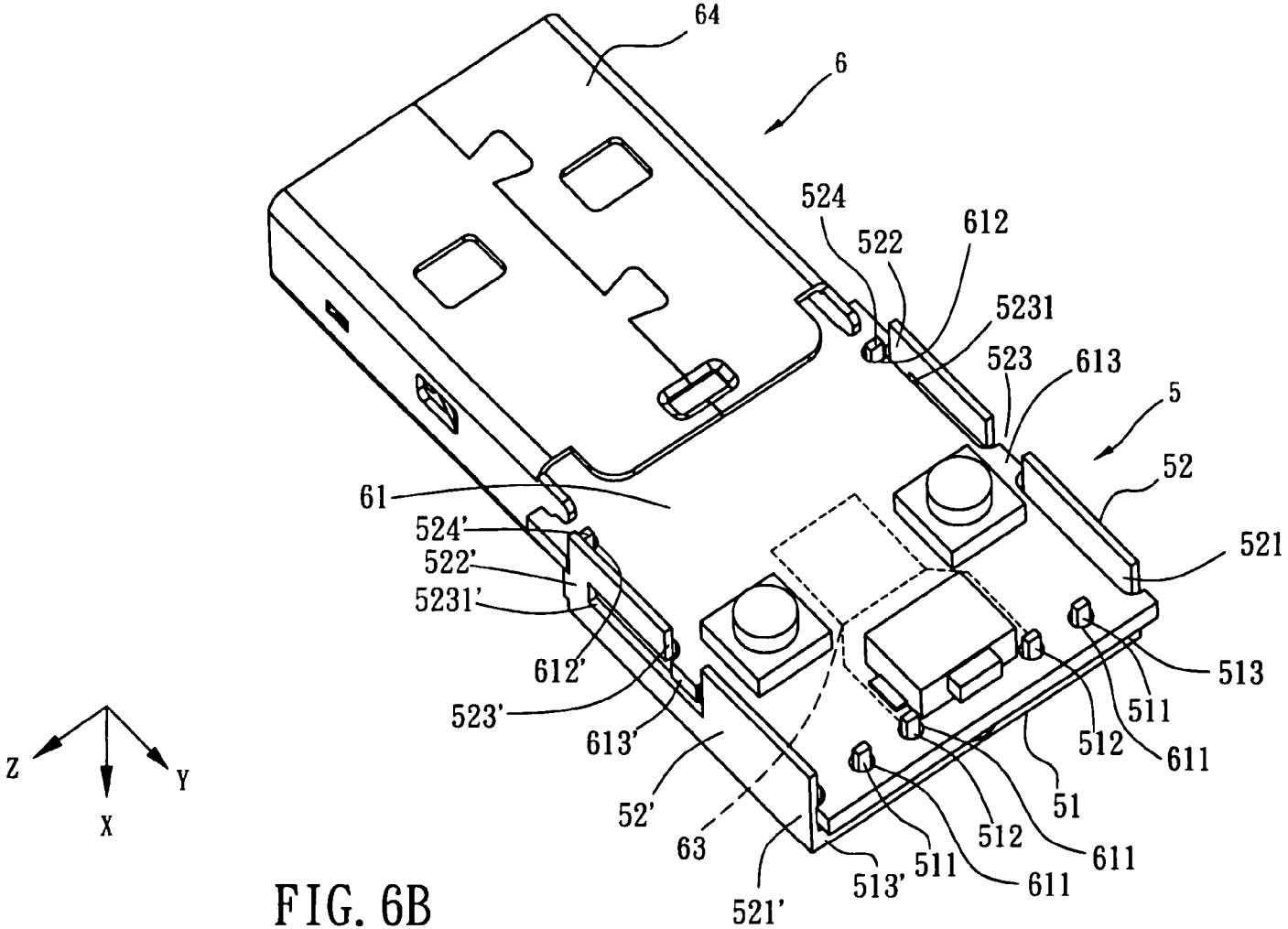
FIG. 6B is a bottom perspective view of an embodiment of a wireless network device having the planar inverted-F antenna of the present invention.

Referring again to FIG. 4, the left and right radiators 52, 52' have end portions 521, 521' respectively and perpendicularly connected to the two ends 513, 513' of the connecting member 51 and are parallel to each other, thus forming the U-shaped structure of the planer inverted-F antenna 5 of the present invention. Also, the left and right radiators 52, 52' are provided with L-shaped notches 523, 523' to form barbs, respectively. The left and right radiators 52, 52' further have end portions 522, 522' which are bent toward each other to form engaging ends 524, 524', respectively. The engaging ends 524, 524' are generally parallel to the connecting member 51 so as to engage with a wireless network device 6 (as shown in FIGS. 6A and 6B).

The L-shaped notches 523, 523' of the left and right radiators 52, 52' are each composed of an open section and a slot 5231, 5231'. The two open sections extend in the same vertical direction as the input ends 511 and the ground ends 512. The two slots 5231, 5231' are perpendicular to the open sections to which they are respectively connected. In other words, the two slots 5231, 5231' extend respectively and horizontally toward the end portions 522, 522' of the left and right radiators 52, 52'. Furthermore, the height H of each of the two end portions 521, 521' of the left and right radiators 52, 52' is greater than the height h of each input end 511 and of each ground end 512 (i.e., H>h).

With H also being the height of each of the two ends 513, 513' of the connecting member 51 that the two end portions 521, 521' of the left and right radiators 52, 52' are respectively connected to; L1 being the length of each of the left and right radiators 52, 52'; L2 being the length of the connecting member 51; W1 being the width of the open section of each of the L-shaped notches 523, 523'; and W2 being the width of each of the slots 5231, 5231', the dimensions of the planar inverted-F antenna 5 of the present invention are in the following ranges:

3 mm<H<5 mm; 11 mm<L1<14 mm; 10 mm<L2<15 mm; 0.5 mm<W1<3 mm; and 0.2 mm<W2<1.5 mm.

In the present preferred embodiment of the present invention, the planar inverted-F antenna 5 operates in a frequency band ranging generally from 2.2 GHz to 2.6 GHz. In another preferred embodiment, the planar inverted-F antenna 5 operates in a frequency band ranging generally from 2.4 GHZ to 2.5 GHz, which band conforms to the wireless communication frequency band specified in IEEE 802.11b/g.

Please refer to FIG. 6A and FIG. 6B for a top perspective view and a bottom perspective view, respectively, of an embodiment of a wireless network device having the planar inverted-F antenna of the present invention. In this preferred embodiment, the planer inverted-F antenna 5 is assembled to a wireless network device 6 which includes a substrate 61, a control circuit 62, a grounding (GND) portion 63, and a universal serial bus (USB) connector 64. The substrate 61 is made of a dielectric material and has a plurality of openings 611. The grounding portion 63 is configured for electrical grounding and extensively covers the area where the planer inverted-F antenna 5 is located.

The control circuit 62 is provided on the substrate 61; includes a circuit layout, several integrated circuit (IC) elements, and several electronic elements; and is configured for wireless network transmission in accordance with the 802.11a, 802.11b, 802.11g, 802.11n and/or ultra-wideband communication standards. As the control circuit 62 is well known in the art and not a major technical feature of the present invention, a detailed description of the control circuit 62 is omitted herein.

The planar inverted-F antenna 5 is installed on the substrate 61 of the wireless network device 6. The engaging ends 524, 524', which are formed by bending the left and right radiators 52, 52', and the L-shaped notches 523, 523' are engaged with the substrate 61 and, more particularly, with two recesses 612, 612' and two positioning ends 613, 613' formed on the periphery of the substrate 61, respectively. Also, the left and right radiators 52, 52' have surfaces generally perpendicular to a surface of the substrate 61, thus allowing the planar inverted-F antenna 5 to effect vertical oscillation. The two ground ends 512 pass through the corresponding openings 611 of the substrate 61 and are electrically connected to the grounding portion 63 of the substrate 61 by soldering. Likewise, the two input ends 511 are inserted through the corresponding openings 611 of the substrate 61 and are electrically connected to the control circuit 62 of the substrate 61 by soldering. Thus, the left and right radiators 52, 52' and the substrate 61 jointly form an electrical circuit capable of producing oscillation frequencies.

The USB connector 64 of the wireless network device 6 is electrically connected to the control circuit 62 of the substrate 61 and conforms to either USB2.0 or USB3.0 specifications. It is understood that the wireless network device 6 may further include a Bluetooth device (not shown) electrically connected to the control circuit 62 so as to enable Bluetooth transmission. Since Bluetooth technology is a well-known and widely used wireless communication technique, a detailed description thereof is omitted herein.

According to the foregoing, the planar inverted-F antenna 5 can be rapidly and conveniently assembled to the substrate 61 of the wireless network device 6 while reducing the overall volume of the assembly.

Figure 7A:
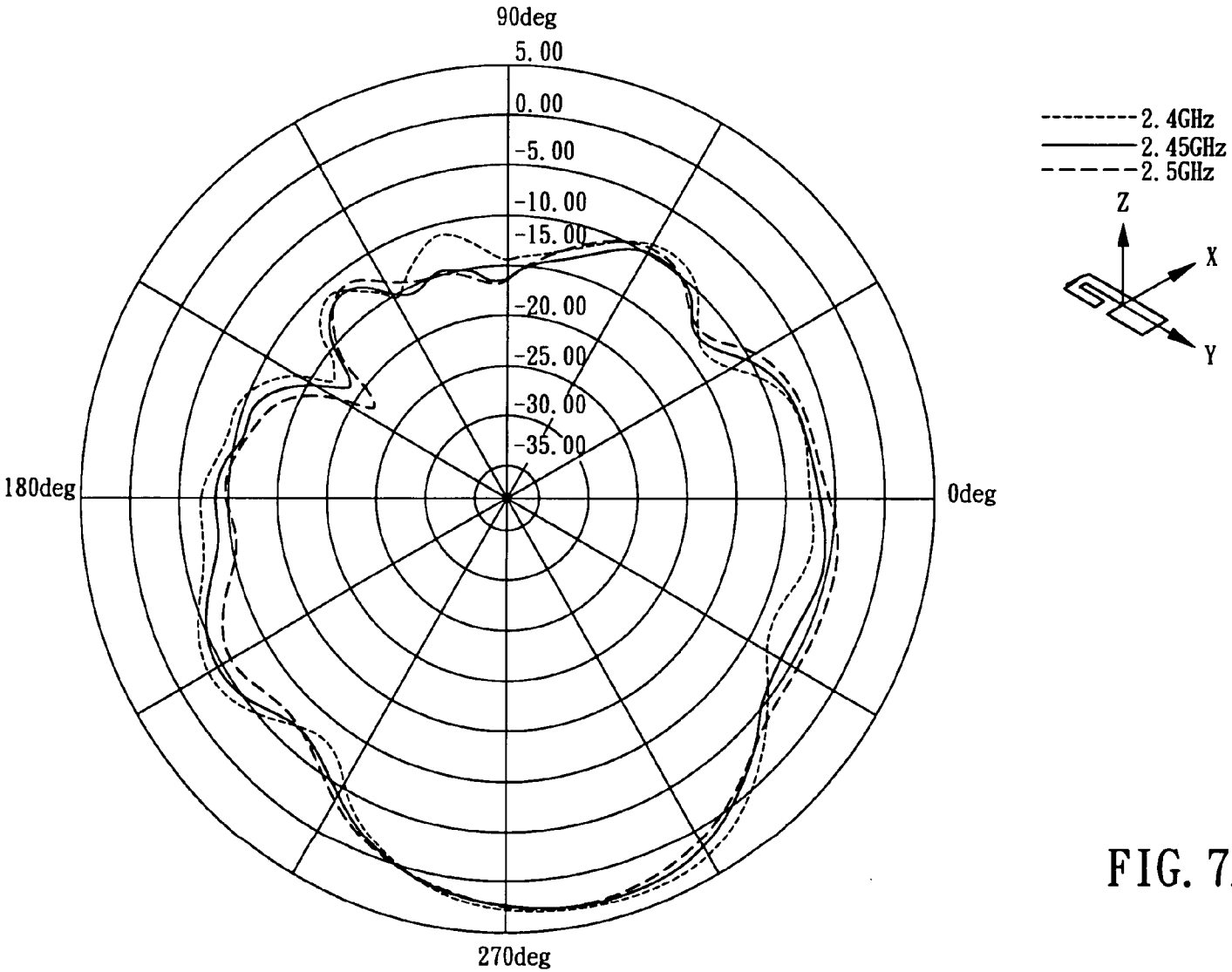
FIG. 7A shows X-Y plane radiation patterns plotted from the test results of a left radiator of the planar inverted-F antenna of the present invention in the application band (2.4 GHz~2.5 GHz)
Figure 7B:
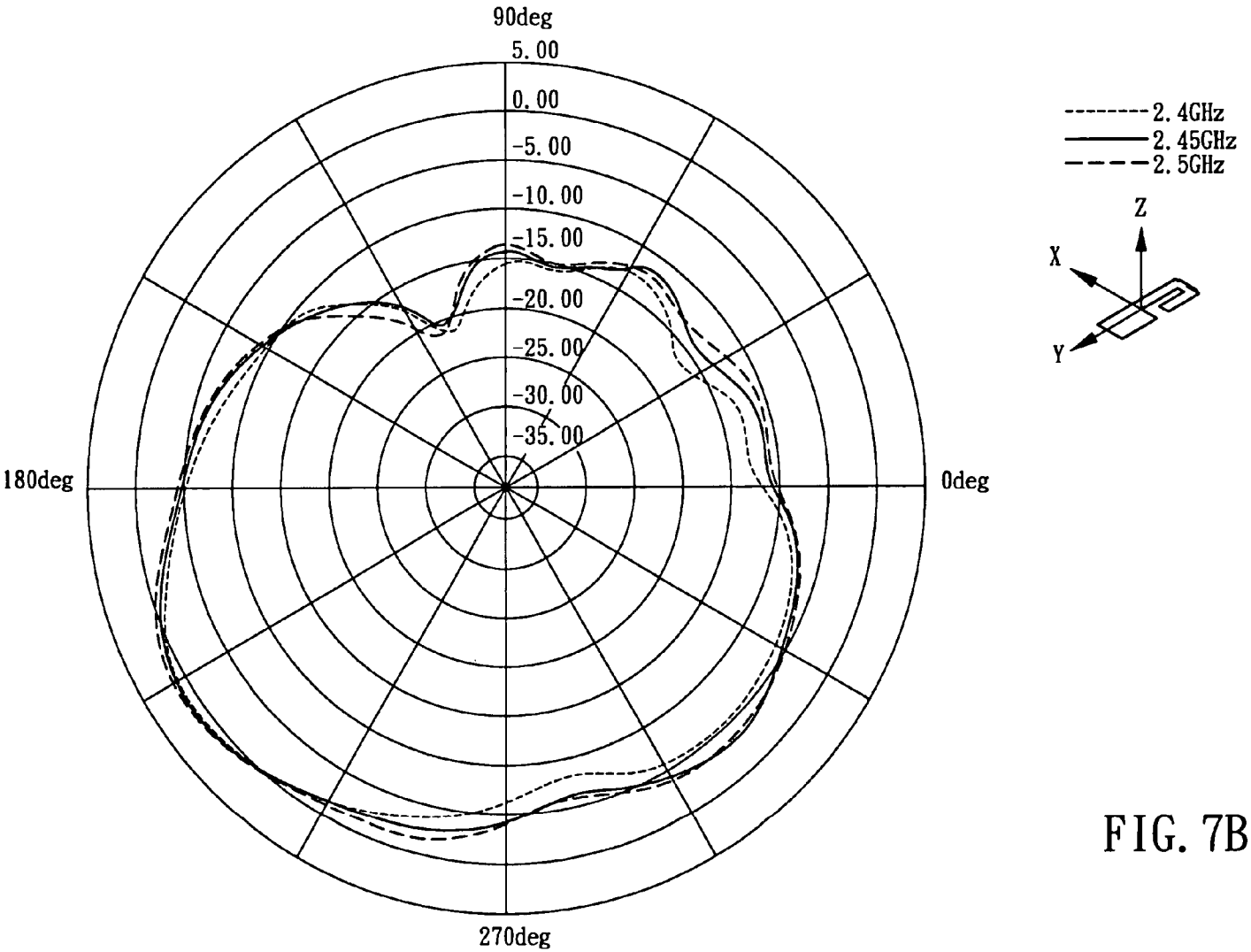
FIG. 7B shows X-Y plane radiation patterns plotted from the test results of a right radiator of the planar inverted-F antenna of the present invention in the application band (2.4 GHz~2.5 GHz)

FIG. 7A shows X-Y plane radiation patterns plotted from test results of the left radiator 52 of the planar inverted-F antenna 5 at application frequencies of 2.4 GHz, 2.45 GHz, and 2.5 GHz. FIG. 7B shows X-Y plane radiation patterns plotted from test results of the right radiator 52' of the planar inverted-F antenna 5 at application frequencies of 2.4 GHz, 2.45 GHz, and 2.5 GHz.

The X-Y plane radiation patterns of the left and right radiators 52, 52' of the planar inverted-F antenna 5 are summarized as Table 1, which shows the maximum and average values of horizontal, vertical, and overall gain corresponding to the application frequencies of 2.4 GHz, 2.45 GHz, and 2.5 GHz.

TABLE 1

| | | X-Y Plane | | | | | |
|---|---|---|---|---|---|---|---|
| | Frequency | Horizontal (dBi) | | Vertical (dBi) | | Overall (dBi) | |
| PIFA | (GHz) | Max. | Avg. | Max. | Avg. | Max. | Avg. |
| Left | 2.4 | 3.69 | −4.14 | −5.51 | −13.02 | 3.76 | −3.61 |
| Radiator | 2.45 | 3.09 | −4.7 | −5.26 | −12.54 | 3.23 | −4.03 |
| | 2.5 | 2.82 | −4.8 | −5.38 | −12.44 | 2.99 | −4.11 |
| Right | 2.4 | 0.88 | −6.88 | −7.99 | −13 | 0.89 | −5.93 |
| Radiator | 2.45 | 1.12 | −6.13 | −7.35 | −11.95 | 1.16 | −5.12 |
| | 2.5 | 1.54 | −5.81 | −7.92 | −11.99 | 1.59 | −4.87 |

Referring to the radiation patterns of FIG. 7A in conjunction with Table 1, the maximum and average overall gain values of the left radiator 52 at 2.4 GHz are as high as 3.76 dBi and −3.61 dBi, respectively. On the other hand, the radiation patterns of FIG. 7B and Table 1 show that the maximum and average overall gain values of the right radiator 52' at 2.4 GHz reach 0.89 dBi and −5.93 dBi, respectively.

Figure 1:
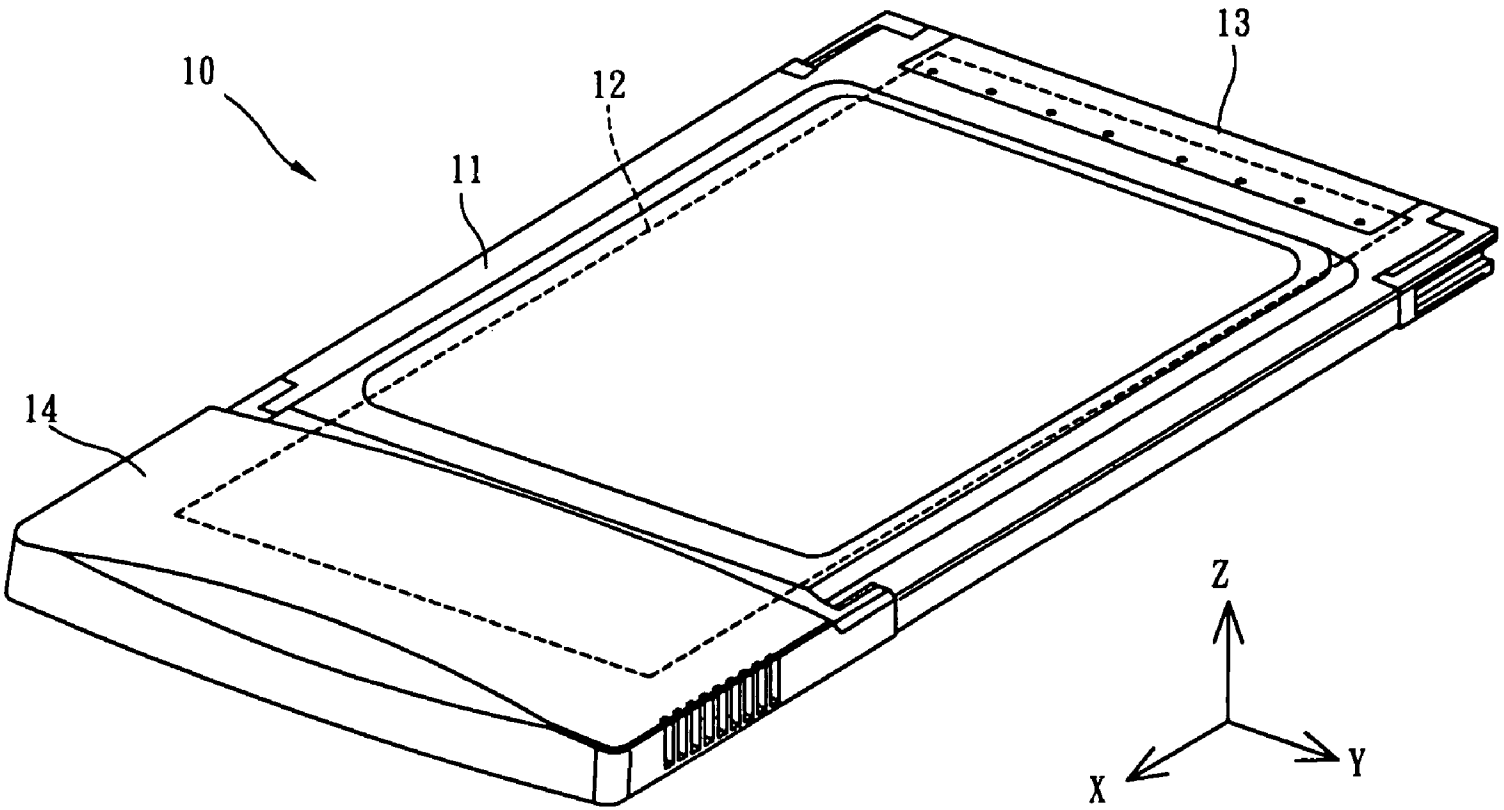
FIG. 1 (PRIOR ART)
FIG. 1 is a perspective view of a typical wireless network device.
Figure 2:
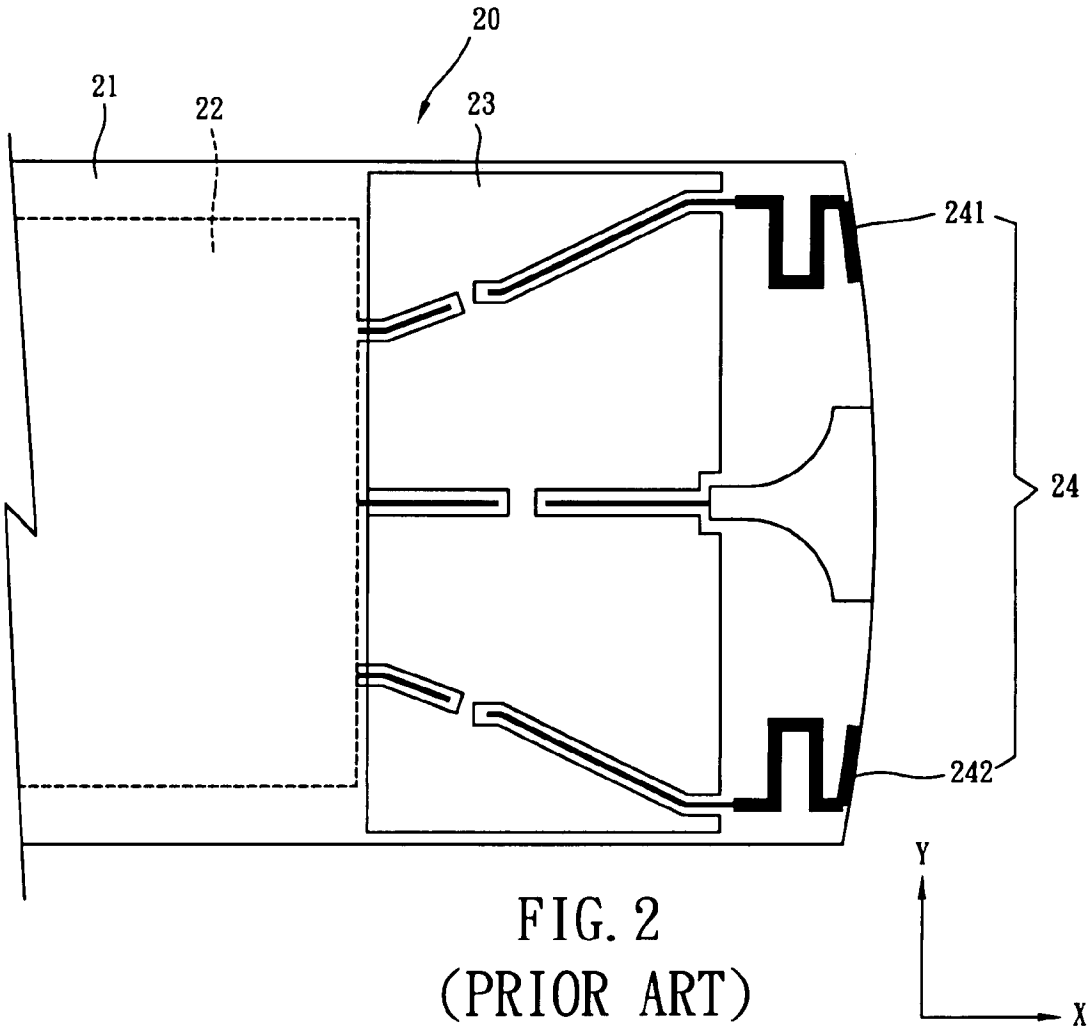
FIG. 2 (PRIOR ART)
FIG. 2 schematically shows a conventional internal circuit device for use in a wireless network device.
Figure 3:
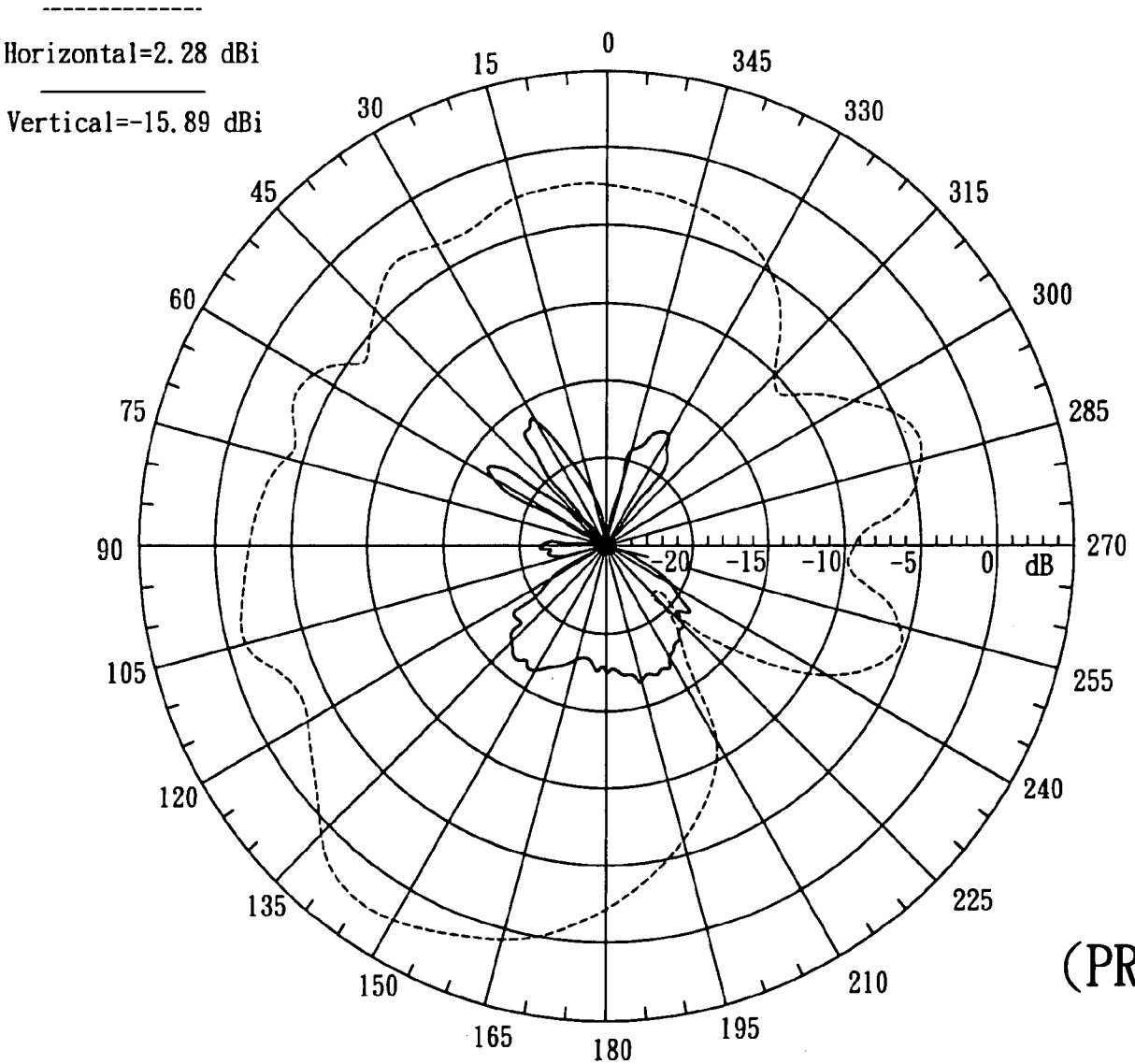
FIG. 3 (PRIOR ART)
FIG. 3 shows X-Y plane radiation patterns plotted from test results of a first antenna of the conventional antenna unit shown in FIG. 2.

Besides, it can be known from FIGS. 7A and 7B and Table 1 that the gain values of the left and right radiators 52, 52' of the planar inverted-F antenna 5 in the X-Y plane are much higher than those shown in FIG. 3 of the prior art device. In addition, the gain values of the left and right radiators 52, 52' of the planar inverted-F antenna 5 form generally circular radiation patterns, meaning that the planar inverted-F antenna 5 is capable of relatively uniform radiation at different angles and in different directions, has no dead zones, and therefore provides good communication quality.

Figure 8A:
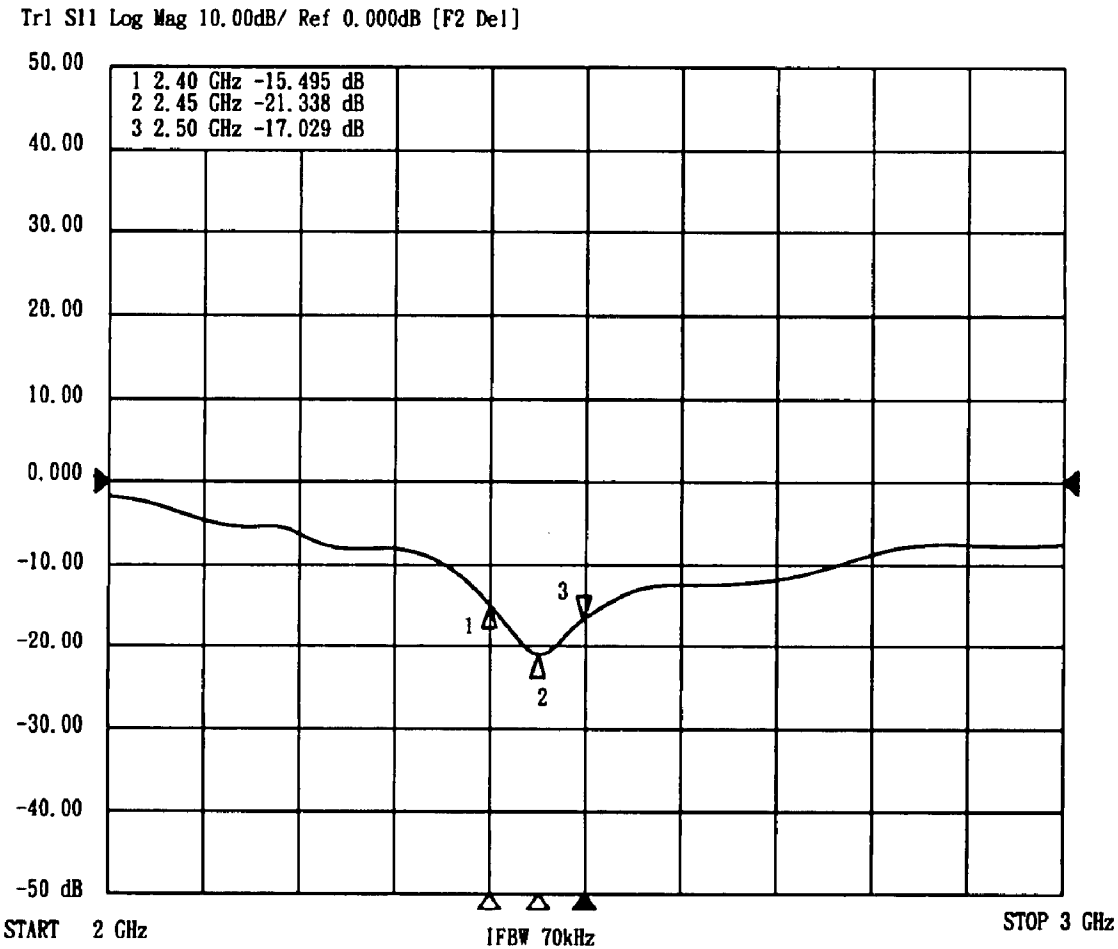
FIG. 8A is a return loss plot for the left radiator of the planar inverted-F antenna of the present invention.
Figure 8B:
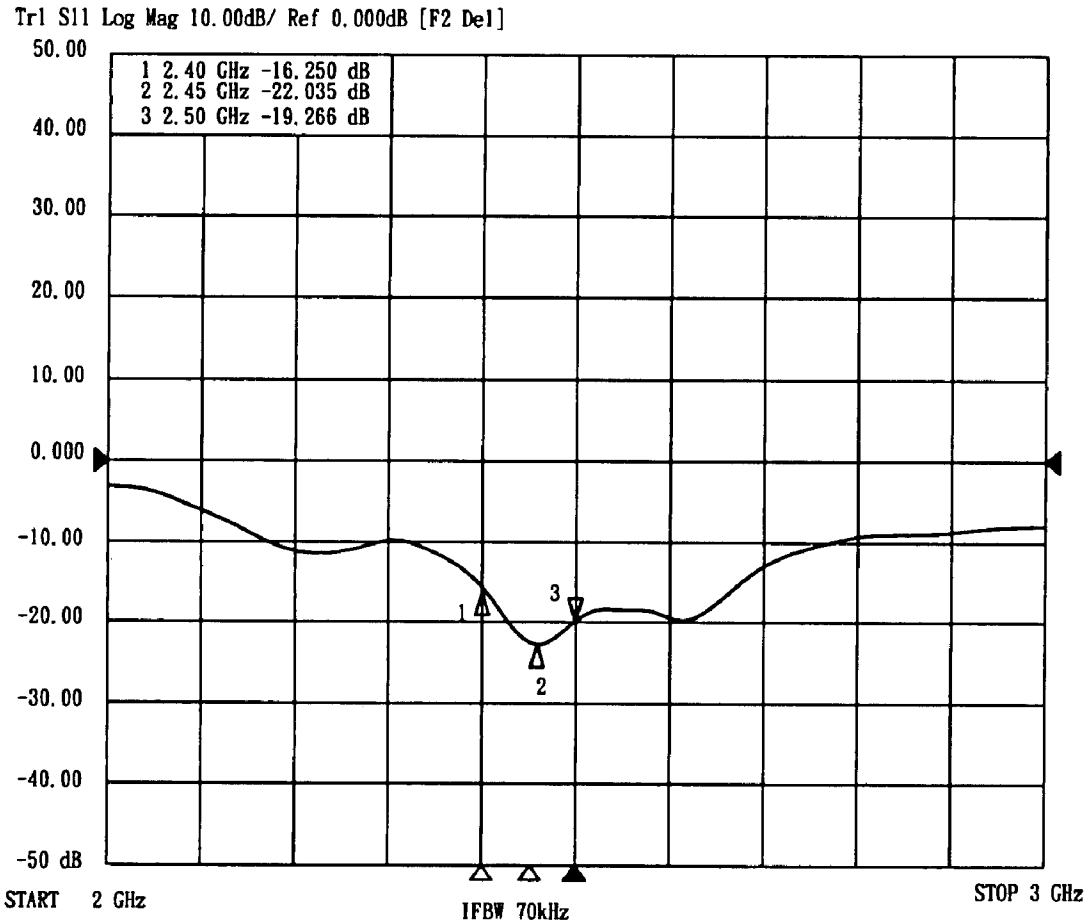
FIG. 8B is a return loss plot for the right radiator of the planar inverted-F antenna of the present invention.

FIG. 8A and FIG. 8B show the test results of return losses of the left and right radiators 52, 52' of the planar inverted-F antenna 5, respectively. Referring to FIG. 8A, the return loss of the left radiator 52 of the planar inverted-F antenna 5 at 2.4 GHz~2.5 GHz ranges generally from −15.495 dBi to −17.029 dBi. As shown in FIG. 8B, the return loss of the right radiator 52' of the planar inverted-F antenna 5 at 2.4 GHz~2.5 GHz ranges generally from −16.250 dBi to −19.266 dBi. Hence, the return loss of each of the left and right radiators 52, 52' is lower than −10 dBi and therefore meets the design requirements of high-performance wireless antennas on the market. It follows that the left and right radiators 52, 52' of the antenna 5 of the present invention provide efficient signal transmission, enable high-quality and stable single-band wireless communication, and help reduce costs.

The present invention has been described with preferred embodiments thereof, and it is understood that many changes and modifications to the described embodiment can be carried out without departing from the scope and the spirit of the invention that is intended to be limited only by the appended claims.

What is claimed is:

1. A planar inverted-F antenna, comprising:

a connecting member having at least an input end and at least a ground end; and two radiators each having a first end portion perpendicularly connected to the connecting member, the two radiators being parallel and corresponding in shape to each other;

wherein each said radiator has an L-shaped notch and thus forms a barb, and each said radiator has a second end portion bent into an engaging end, the engaging ends being parallel to the connecting member.

2. The planar inverted-F antenna of claim 1, wherein the planar inverted-F antenna is a single-piece three-dimensional element integrally formed by stamping a thin conductive metal plate.

3. The planar inverted-F antenna of claim 1, wherein the connecting member has two ends connected to the two radiators, respectively, and each said end has a height greater than a height of each said input end and of each said ground end.

4. The planar inverted-F antenna of claim 1, wherein there are two said input ends and two said ground ends, and the two input ends are provided on two sides of the two ground ends, respectively.

5. The planar inverted-F antenna of claim 1, wherein the engaging ends formed by bending the radiators and the L-shaped notches are engaged with a substrate of a wireless network device and, more specifically, are engaged with recesses and positioning ends formed at a periphery of the substrate, respectively, and each said radiator has a surface perpendicular to a surface of the substrate.

6. The planar inverted-F antenna of claim 5, wherein the at least a ground end is electrically connected to a grounding portion of the substrate, and the at least an input end is electrically connected to a control circuit of the substrate.

7. The planar inverted-F antenna of claim 1, wherein the planar inverted-F antenna operates in a frequency band ranging from 2.4 GHz to 2.5 GHz.

8. The planar inverted-F antenna of claim 1, wherein the L-shaped notch of each said radiator has: an open section extending in a same direction as the at least an input end and the at least a ground end; and a slot which is perpendicular to the open section and extends toward the second end portion of the radiator where a corresponding said engaging end is formed.

9. The planar inverted-F antenna of claim 8, wherein the connecting member has two ends connected with the two radiators, respectively, each said end of the connecting member having a height H, each said radiator having a length L1, the connecting member having a length L2, the open section of each said L-shaped notch having a width W1, and the slot of each said L-shaped notch having a width W2, in which:

3 mm<H<5 mm;

11 mm<L1<14 mm;

10 mm<L2<15 mm;

0.5 mm<W1<3 mm; and 0.2 mm<W2<1.5 mm.

10. A wireless network device having a planar inverted-F antenna, the wireless network device comprising:

a substrate made of a dielectric material and having a plurality of openings and a grounding portion configured for electrical grounding;

a control circuit provided on the substrate and configured for wireless network communication; and at least a said planar inverted-F antenna having a U-shaped structure and provided on the substrate, wherein each said planar inverted-F antenna comprises:

a connecting member having at least an input end and at least a ground end which are inserted in the openings, respectively, such that the substrate is located between two radiators; and the two radiators each having a first end portion connected to the connecting member, the two radiators being parallel and corresponding in shape to each other and being perpendicular to the connecting member;

wherein each said radiator has an L-shaped notch and thus forms a barb, each said radiator having a second end portion bent into an engaging end parallel to the connecting member, the at least a ground end being electrically connected to the grounding portion of the substrate, and the at least an input end being electrically connected to the control circuit of the substrate.

11. The wireless network device of claim 10, wherein the planar inverted-F antenna is a single-piece three-dimensional element integrally formed by stamping a thin conductive metal plate.

12. The wireless network device of claim 10, wherein the connecting member has two ends connected to the two radiators, respectively, and each said end has a height greater than a height of each said input end and of each said ground end.

13. The wireless network device of claim 10, wherein there are two said input ends and two said ground ends, and the two input ends are provided on two sides of the two ground ends, respectively.

14. The wireless network device of claim 10, wherein the engaging ends formed by bending the radiators and the L-shaped notches are engaged with the substrate and, more specifically, are engaged with recesses and positioning ends formed at a periphery of the substrate, respectively, and each said radiator has a surface perpendicular to a surface of the substrate.

15. The wireless network device of claim 10, wherein the L-shaped notch of each said radiator has: an open section extending in a same direction as the at least an input end and the at least a ground end; and a slot which is perpendicular to the open section and extends toward the second end portion of the radiator where a corresponding said engaging end is formed.

16. The wireless network device of claim 10, wherein the connecting member has two ends connected with the two radiators, respectively, each said end of the connecting member having a height H, each said radiator having a length L1, the connecting member having a length L2, the open section of each said L-shaped notch having a width W1, and the slot of each said L-shaped notch having a width W2, in which:

3 mm<H<5 mm;

11 mm<L1<14 mm;

10 mm<L2<15 mm;

0.5 mm<W1<3 mm; and 0.2 mm<W2<1.5 mm.

17. The wireless network device of claim 10, further comprising a universal serial bus (USB) connector electrically connected to the control circuit of the substrate, wherein the USB connector conforms to USB2.0 or USB3.0 specifications.

18. The wireless network device of claim 10, wherein the planar inverted-F antenna operates in a frequency band ranging from 2.4 GHz to 2.5 GHz.

* * * * *